United States Patent [19]

Wu

[11] Patent Number: 5,003,293

[45] Date of Patent: Mar. 26, 1991

[54] BILLBOARD WITH AUDIO MESSAGE SPREADING FUNCTION

[75] Inventor: Eric Wu, Chang, Taiwan

[73] Assignee: Compunic Electronics Co., Ltd., Taipei, Taiwan

[21] Appl. No.: 416,196

[22] Filed: Oct. 2, 1989

[51] Int. Cl.[5] ..... G08B 23/00

[52] U.S. Cl. ..... 340/573; 250/342; 340/693

[58] Field of Search ..... 340/555-556, 340/567, 573, 692, 693; 364/516; 250/342, 221

[56] References Cited

U.S. PATENT DOCUMENTS

| | | | |
|---|---|---|---|
| 4,645,930 | 2/1987 | Zierhut | 250/342 |
| 4,709,153 | 11/1987 | Schofield | 250/342 X |
| 4,709,330 | 11/1987 | Yokoi et al. | 340/573 X |
| 4,710,629 | 12/1987 | Müller et al. | 250/342 |
| 4,853,678 | 8/1989 | Bishop, Jr. et al. | 340/573 |

*Primary Examiner*—Glen R. Swann, III
*Assistant Examiner*—Thomas J. Mullen, Jr.
*Attorney, Agent, or Firm*—Sughrue, Mion, Zinn, Macpeak & Seas

[57] ABSTRACT

A message spreading apparatus is disclosed to generate an audio message output in response to the presence of a heat radiation generated by body heat. A housing has a front wall provided with an opening therein and a rear wall including a first portion opposed to the opening of the front wall, with the front wall and the rear wall being spaced a predetermined distance from each other. A radiation reflecting member is mounted to the first portion of the rear wall and is configured and arranged so as to reflect a portion of a heat radiation ray entered through the opening of the front wall to a path which is between the front wall and the rear wall and is in a direction substantially parallel to the respective planes of the front and rear walls. A pyroelectric sensor is provided in the path to sense the reflected heat radiation ray and generate an activating signal in response to the reflected heat radiation ray. An audio circuit is also located between the front and rear walls and is operatively coupled to the pyroelectric sensor for generating an audio message output in response to the activating signal. In an alternative embodiment, a photo-sensor is adopted to actuate the audio message output by sensing the variance in the luminosity of a light beam entered through the opening of the front wall.

19 Claims, 4 Drawing Sheets

BILLBOARD WITH AUDIO MESSAGE SPREADING FUNCTION

BACKGROUND OF THE INVENTION

The present invention relates generally to a billboard and, more particularly, to a billboard which will spread a predetermined audio message to a person upon detecting the approach of the person and which has a minimized size so that it occupies only a small space in use.

Typically, a billboard is used as an advertising medium to introduce and promote goods for sale in a shop, store, drugstore, department store, and so on. At present, a billboard usually includes a piece of paper bearing a two-dimensional picture or drawing and attached to a backboard hung on a wall. The picture or drawing shows the outer appearance of the goods to be promoted. To achieve a higher advertisement effect, cubic models for the goods to be promoted have been used. However, these known billboards occupy more space and are costly and inconvenient to be replaced with new ones. The promotion effect achieved by these known billboards is constrained. There is a necessity for a billboard which is more attractive and allows the easy change of advertising pictures.

SUMMARY OF THE INVENTION

Therefore, it is a primary object of the present invention to provide a billboard of a design in which the billboard will automatically output a predetermined audio masseage promoting the predetermined goods upon detecting the approach of a person.

It is the second object of the present invention to provide a billboard which has a reduced dimension in its thickness direction.

It is a further object of the present invention to provide a billboard which allows an advertising picture to be easily changed.

It is a still further object of the present invention to provide a billboard which allows the audio message for promoting goods to be easily changed.

In accordance with a preferred embodiment of the present invention, a billboard is provided to generate a predetermined audio message output in response to the presence of a heat radiation generated by human body heat. The billboard comprises: a housing having a front wall and a rear wall spaced a predetermined distance from each other, the front wall having an opening, the rear wall having a first portion opposed to the opening of the front wall; a radiation reflecting member mounted to the first portion of the rear wall and configured and arranged so as to reflect a portion of a heat radiation ray entered through the opening of the front wall to a path which is between the front wall the rear wall and is in a direction substantially parallel to the respective planes of the front and rear walls; a heat radiation sensing element provided in the path to sense the reflected heat radiation ray and generate an activating signal in response to the reflected heat radiation ray; and audio circuit means located between the front wall and the rear wall and operatively coupled to the heat radiation sensing element, for generating an audio message output in response to the activating signal.

Preferably, the heat radiation sensing element comprises a pyroelectric sensor. The reflecting member includes a reflecting plate having a pair of first and second legs. The first leg is mounted at a first end thereof to the first portion of the rear wall with a longitudinal axis of th first leg being substantially perpendicular to the plane of the rear wall, and is connected at a second end thereof to a first end of the second leg. The second leg extends at an angle of approximately 45 degrees to the plane of the rear wall from the first end thereof toward the rear wall and is mounted at a second end thereof to the first portion of the rear wall. The second leg has a first reflecting surface provided between the first and second ends thereof and adapted to reflect a heat radiation ray. The first reflecting surface is configured and arranged to face at a first angle of approximately 45 degrees toward the opening of the front wall and at a second angle of approximately 45 degrees toward the path. Thereby, when a heat radiation ray enters substantially perpendicularly through the opening of the front wall to impinge upon the first reflecting surface of the second leg, the heat radiation ray will be reflected to travel along the path so as to be sensed by the sening element.

According to the preferred embodiment of the present invention, the reflecting plate further has a pair of first and second arms outwardly and inclinedly extending, near the first end of the second leg, respectively from each of the two opposite lateral edges of the second leg of the reflecting plate. The first arm and the second arm have second and third reflecting surfaces, respectively, configured and arranged to reflect a portion of a heat radiation ray which enters through the opening of the front wall but does not impinge upon the first reflecting surface toward the path.so as to be sensed by the sensing element.

The audio circuit means includes memory means for prestoring predetermined audio message data and audio synthesizing circuit means coupled between the memory means and the sensing element for outputting the predetermined audio message in a synthetic audio form in response to the activating signal. Preferably, the memory means comprises a memory IC for storing the predetermined audio message data and an IC socket for removably receiving the memory IC and for electically connecting the memory IC to the audio synthesizing circuit means.

According to a preferred embodiment of the present invention, the front wall has a boundary ridge provided on an outer surface thereof in a portion of the front wall other than the opening and extending along edges of the other portion of the front wall. The ridge has recesses provided in the inner lateral side surfaces thereof. The ridge surrounds an area of a predetermined profile. The message spreading apparatus further comprises a flexible transparent retaining plate of a profile substantially the same as the predetermined profile of the area surrounded by the ridge so that the retaining plate is allowed to be received in position in the area surrounded by the ridge. The retaining plate has tabs provided along edges thereof at positions corresponding to the positions of the recesses on the ridge. Each of these tabs extends outwardly a predetermined short distance from the edges of the retaining plate in the plane of the retaining plate so that when the retaining plate is received in the surrounded area, each of the tabs may be inserted into and releasably engaged in each of the recesses of the ridge so as to releasably hold the retaining plate in its received position.

Preferably, the retaining plate has at least one notch provided along the edges thereof in a portion of the edges thereof other than the portions in which the tabs are provided. The notch is configured and arranged to be adapted to be engaged by a finger so as to allow the retaining plate to be removed from the received position by disengaging the tabs out of the recesses.

According to an alternative embodiment of the present invention, a billboard is provided to generate a predetermined audio message output in response to the variance in the luminosity of a beam of light entered the billboard. The billboard comprises: a housing having a front wall and a rear wall spaced a predetermined distance from each other, the front wall having an opening adapted to allow a beam of light to enter therethrough, the rear wall having a first portion opposed to the opening of the front wall; a luminosity variance detecting assembly mounted to the first portion of the rear wall and configured and arranged so as to detect the variance in the luminosity of the light beam entering through the opening of the front wall and to generate an activating signal in response to the detected variance; and audio circuit means located between the front wall and the rear wall and operatively coupled to the luminosity variance detecting assembly, for generating an audio message output in response to the activating signal. The luminosity variance detecting assembly includes a photo-sensor having a sensing surface for detecting the variance in the luminosity of a light beam impringed thereupon; a mounting base mounted to the first portion of the rear wall and having a cavity for receiving the photo-sensor, the cavity having a first inner diameter and being configured and arranged so as to receive the photo-sensor with the sensing surface of the photo-sensor facing the opening of the front wall; and a light directing tube component having an inner through bore which has a first portion of a second inner diameter and a second portion of a third inner diameter larger than the second inner diameter. The tube component has a first end corresponding to the first portion of the through bore and a second end corresponding to the second portion of the through bore with the second end having a largest outer diameter substantially equal to the first inner diameter of the cavity so that the tube component may be connected to the mounting base by inserting the second end of the tube component into the cavity with the photo-sensor being laid between the second end of the tube component and the mounting base and with the first end of the tube component being left outside of the cavity and directed toward the opening of the front wall to define in the through bore a light path for the photo-sensor. The light path has an axis substantially perpendicular to the sensing surface of the photo-sensor.

Preferably, the photo-sensor is a sensor selected from the group consisting of a photo-diode and a CdS sensor.

BRIEF DESCRIPTION OF THE DRAWINGS

The present invention can be more fully understood by reference to the following description and accompanying drawings, which form an integral part of this application.

DETAILED DESCRIPTION OF THE PREFERRED EMBODIMENTS

Figure 1:
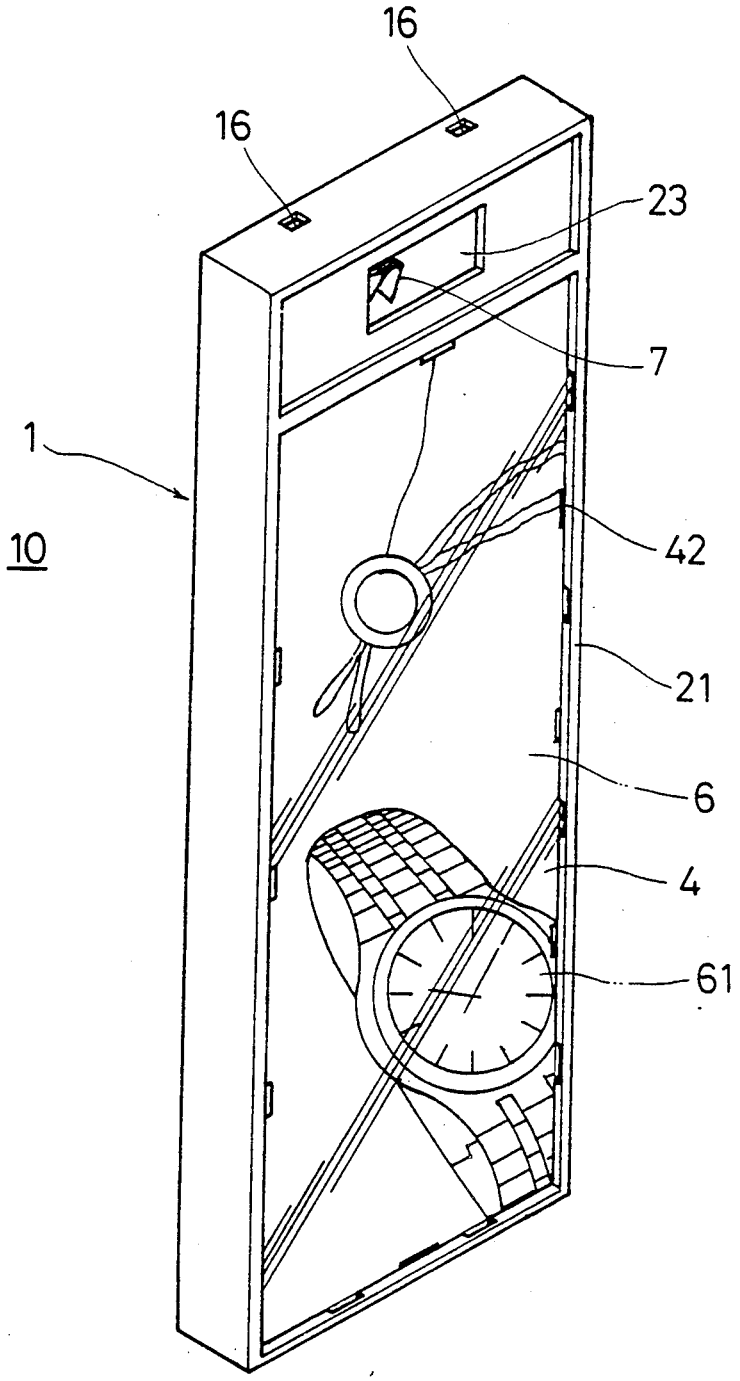
FIG. 1 is a perspective view of a billboard according to a preferred embodiment of the present invention.
Figures 2, 2A:
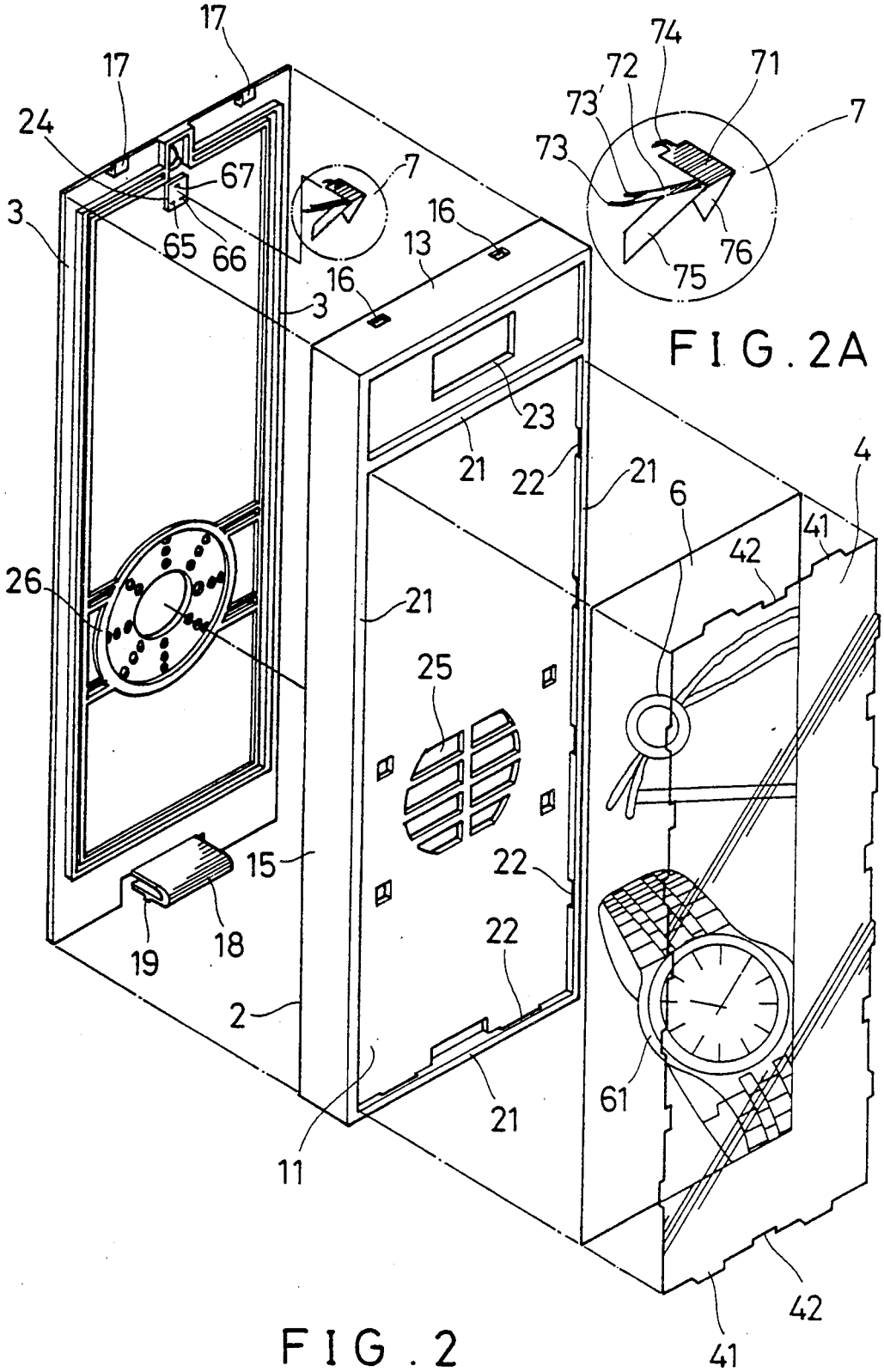
FIG. 2 is an exploded perspective view of the billboard shown in FIG. 1, showing the essential parts of the invention.
Figure 3:
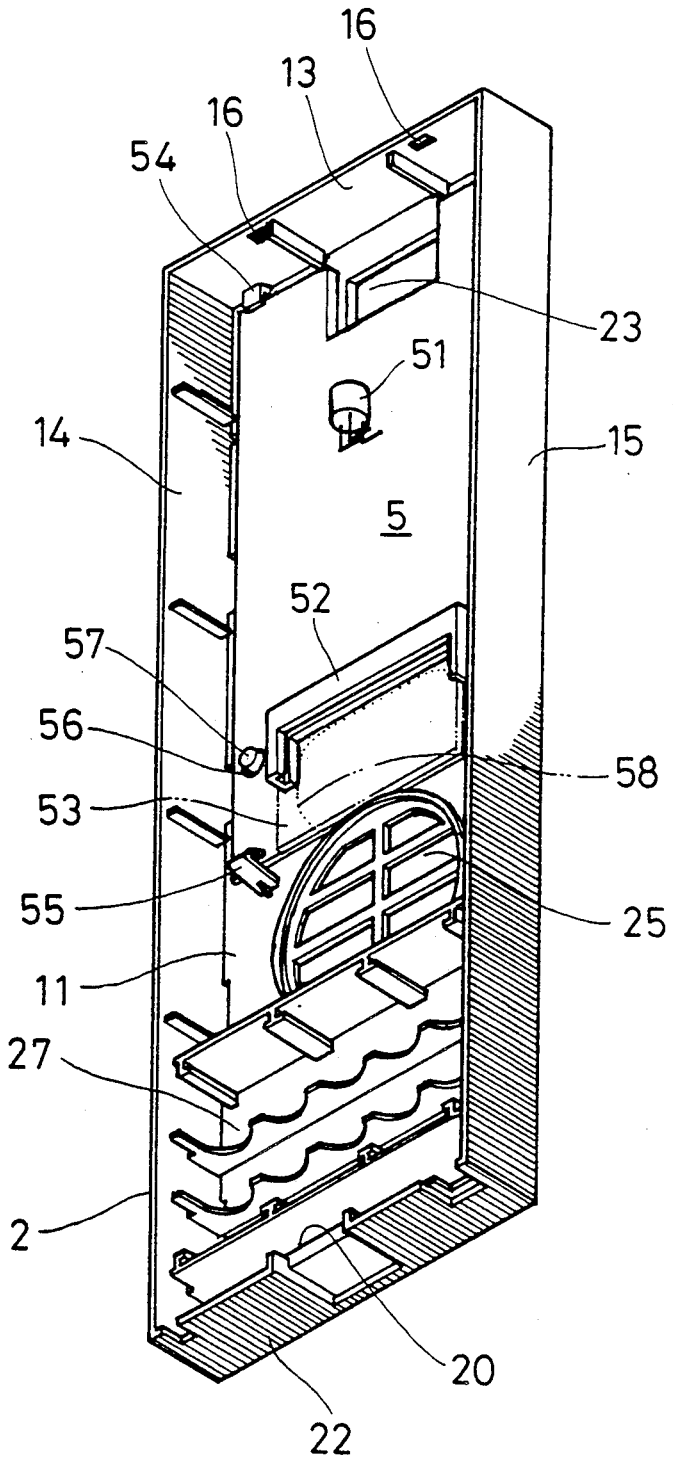
FIG. 3 is a rear perspective view of a front half shell of a housing for the billboard according to the preferred embodiment of the present invention.

Referring now to FIGS. 1, 2 and 3, a billboard 10 according to a preferred embodiment of the present invention is illustrated to include a housing 1 which has a front half shell 2, a rear cover plate 3 and a transparent retaining plate 4. As shown in FIG. 3, the front half shell 2 has a front wall 11, a bottom wall 12, a top wall 13 and two side walls 14, 15. The rear cover plate 3 constitutes a rear wall for the front half shell 2 and, therefore, for the housing 1. In the top wall 13, there are provided with a pair of retaining openings 16. A pair of retaining ears 17 configured to be engaged in the retaining openings 16 upon combination of the front half shell 2 and the rear cover plate 3 are provided on the rear cover plate 3 along a top edge thereof. The rear cover plate 3 has a snap-in retaining arm 18 provided centrally along a bottom edge thereof. The snap-in arm 18 has an engaging ridge 19 while the bottom wall 12 of the front half shell 2 has a retaining edge portion 20 (see FIG. 3) configured to retain the engaging ridge 19 so as to hold the rear cover plate 3 to be combined with the front half shell 2.

As shown in FIG. 2, a boundary ridge 21 is formed on the front surface of the front wall 11 along the circumferential edges of the front surface. The boundary ridge 21 surrounds a substantially rectangular area of a dimension allowing for the accommodation of the transparent retaining plate 4. The retaining plate 4 is formed of a flexible plastic material, such as PC and PVC, and has a small thickness so as to possess good flexibility and transparency. The boundary ridge 21 has a plurality of recesses 22 provided at a predetermined interval in the inner lateral side surfaces thereof. The retaining plate 4 has a plurality of tabs 41 provided along edges thereof at positions corresponding to the positions of the recesses 22 in the ridge 21. Each of the tabs 41 extends outwardly a predetermined short distance from the edges of the retaining plate 4 in the plane of the retaining plate 4 so that when the retaining plate 4 is received in the area surrounded by ridge 21, each of the tabs 41 may be inserted into and releasably engaged in each of the recesses 22 in the ridge 21 so as to releasably hold the retaining plate 4 in its received position. A piece of paper 6 bearing an advertising picture or drawing for goods to be promoted, such as a watch 61 as shown in FIGS. 1 and 2, may be interposed between the front wall 11 and the retaining plate 4.

Preferably, the retaining plate 4 is provided with notches 42 along the edges of the retaining plate 4 in a portion of the edges of the retaining plate 4 other than the portions in which the tabs 41 are provided, e.g. between two adjacent tabs 41. Each of the notches 42 is configured and arranged to be adapted to be engaged by a finger of a person or a pointed article so as to allow the retaining plate 4 to be easily removed from its received position by disengaging the tabs 41 out of the recesses 22. By removing the flexible retaining plate 4 from its received position on the front wall 11, a piece of paper 6 bearing a new, different advertising picture or drawing for goods to be promoted may be placed to substitute the original advertisement. In an alternative form, the paper 6 may be omitted by applying a desired advertisement pattern for goods to be promoted to a surface of the flexible retaining plate 4.

In a portion of the front wall 11 above the flexible plate receiving area, a through opening 23 is provided. On a portion 24 of the rear cover plate 3 opposed to the opening 23, a heat radiation reflecting plate 7 made of metal material is mounted to the rear cover plate 3 for reflecting a heat radiation ray substantially perpendicularly entered through the opening 23 and impinging upon it to a path which is between the front wall 11 and the rear cover plate 3 and which is in a direction substantially normal to the direction of the entered radiation ray and substantially parallel to the respective planes of the front wall 11 and the rear cover plate 3.

As shown in FIG. 2, the reflecting plate 7 has a pair of first and second legs 71 and 72. The first leg 71 is secured at a first distal end thereof to the portion 24 of the rear cover plate 3 with a central tab 74 at the first distal end of leg 71 being inserted into a slit 67 in the portion 24 of the rear cover plate 3. The second leg 72 is secured at a first distal end thereof to the portion 24 of the rear cover plate 3 with two tabs 73 and 73' at its first distal end being respectively inserted into two slits 65 and 66 in the portion 24 of the rear cover plate 3. The three slits 67, 65 and 66 substantially constitute three apexes of an isosceles triangle, respectively.

The plane and the longitudinal axis of the first leg 71 are substantially perpendicular to the plane and a longitudinal central axis of the rectangular rear cover plate 3. The first leg 71 is connected at a second end thereof to a second end of the second leg 72, with the planes and the longitudinal axes of the two legs 71 and 72 forming angles of approximately 45 degrees. These two legs 71 and 72 may be formed by bending an elongate metal plate. Accordingly, the second leg 72 extends at an angle of approximately 45 degrees to the plane of the rear cover plate 3 from its second end toward the rear cover plate 3.

The underside surface of the second leg 72 provides a first reflecting surface adapted to reflect a heat radiation ray generated by the body heat of a person passing before the billboard 10. The first reflecting surface faces opening 23 of the front wall 11 at a first angle of approximately 45 degrees and the path mentioned above at a second angle of approximately 45 degrees. A substantial portion of the heat radiation ray entered through the opening 23 in a direction substantially parallel to the longitudinal axis of the first leg 71 and impinging upon the first reflecting surface will be reflected to the path.

In order to reflect a greater amount of heat radiation to the path, a pair of first and second arms 75 and 76 outwardly and inclinedly extend, near the second end of the secon leg 72, respectively from each of the two opposite lateral edges of the second leg 72. The respective planes of the first and seond arms 75 and 76 are respectively at an angle of approximately 45 degrees to the plane of the second leg 72, and the respective longitudinal axes of the first and second arms 75 and 76 are respectively at an angle of approximately 45 degrees to the respective opposite longitudinal lateral edges of the second leg 72. The first and second arms 75 and 76 have second and third reflecting surfaces, respectively, configured and arranged to reflect a portion of a heat readiation ray, which enters through opening 23 of the front wall 11 but does not impinge upon the first reflecting surface, toward the above-mentioned path. For example, two beams of heat radiation which enter through the opening 23 in two directions at angles of substantially plus and minus 45 degrees, respectively, to the longitudinal axis of the first leg 71 and which impinge upon the second and third reflecting surfaces, respectiely, will be reflected to the above-mentioned path.

In the downstream of the path from the reflecting plate 7, a heat radiation ray sensing element 51 is provided to sense the reflected heat radiation ray and generate an activating signal in response to the reflected heat radiation ray. According to a preferred embodiment of the present invention, the sensing element 51 is a pyroelectric sensor deposited on a printed circuit board 5 (FIG. 2) which includes an audio message memory element 53 (shown in borken line) and a conventional audio message synthesizing circuit (not shown) electrically coupled between the pyroelectric sensor 51 and the memory element 53. Preferably, the memory element 53 is a plug-in memory IC prestoring predetermined audio advertisement message data which will be output in a synthetic audio voice form by the conventional audio message synthesizing circuit when the activating signal is sent from the pyroelectric sensor 51 to the synthesizing circuit. The printed circuit board 5 is provided with a receiving socket 52 for releasably receiving the plug-in memory IC 53 and coupled the memory IC 53 to the conventional audio message synthesizing circuit. Therefore, a different memory IC 53 storing different audio message data may be easily mounted to promote different goods by inserting the different memory IC 53 into the socket 52 to replace the original one. When a heat radiation ray generated by the body heat of a person passing before the billboard 10 enters substantially perpendicularly through the opening 23 of the front wall 11 to impinge upon the reflecting surfaces of the reflecting plate 7, the heat radiation ray will be reflected to travel along the above-identified path so as to be sensed by the pyroelectric sensor 51 which is thus actuated to generate the activating signal. The activating signal then enables the audio message synthesizing circuit on the printed circuit board 5 to output the predetermined audio message stored in the memory IC 53.

An audio message synthesizing circuit and an audio message data storing IC are known to those skilled in the art. The structure for the receiving socket 52 is conventional. A circuit associated with the pyroelectric sensor 51 is also conventional. No further detailed discussion with regard thereto is included hereinafter.

In view of the arrangement of the reflecting plate 7, the pyroelectric sensor 51, the known audio voice message synthesizing circuit and the the memory IC 53, the billboard 10 of the present invention spreads a predetermined audio adverisement message promoting predetermined goods to a person passing before the billboard 10. The thickness of the billboard 10 may be kept small, i.e. the spaced distance between the rear cover plate 3 and the front wall 11 may be kept small. For example, the spaced distance between the rear cover plate 3 and the front wall 11 may be in a range from 10 to 20 mm and, preferably, the spaced distance is approximately 15 mm.

As seen in FIG. 3, the printed circuit board 5 is secured to a rear surface of the front wall 11. A pair of hook elements 54 (only one being shown in FIG. 3) extend upward from the rear surface of the front wall 11 to retain an upper edge of the printed circuit board 5. A pair of resiliently snap-in arms 55 (only one being shown in FIG. 3) formed integrally with the front wall 11 may be urged to deflect so as to allow a lower edge of the printed circuit board 5 to be held by the arms 55. Each of the arms 55 may be formed into an inverse U-shaped or V-shaped form with one of the two legs of the U or V shape being shorter than the other. When retaining the lower edge of the printed circuit board 5, the shorter leg of a U- or V-shaped arm 55 abuts against the upper surfacce of the printed circuit board 5 along the lower edge of the printed circuit board 5. The shorter leg of the arm 55 has a thickness and the arm 55 is arranged so that the shorter leg will abut against the upper surface of the printed circuit board 5 with only a fraction of its thickness so as to allow the shorter leg to be deflected by a small force to release the lower edge of the printed circuit board 5.

A positioning pin 57 extending uprightly from the rear surface of the front wall 11 protrudes through a positioning hole 56 in the printed circuit board 5 to help the board 5 to be mounted in position. The pin 57 is a stepped post (not shown in the drawings) having an upper section of a first diameter and a lower section of a second diameter larger than the first diameter. The hole 56 has a third diameter larger than the first diameter and smaller than the second diameter of the pin 57. The lower section of the pin 57 is configured and arranged so that when the printed circuit board 5 is pressed downward to bring the lower surface of the board 5 to be abutted against by the lower section of the pin 57, the shorter legs of arms 55 may engage the upper surface of the lower edge of the board 5. Before the lower edge of the board 5 is pressed down to be held by the arms 55, a biasing spring body 58 (shown in dotted line in FIG. 3) may be laid beneath the board 5. When the arms 55 are deflected, for example by fingers, to release the lower edge of the board 5, the spring body 58 will urge the board 5 upward to allow an easy detachment of the board 5 from its received position.

In the front wall 11, a poriton 25 is arranged immediately below the mounting position of the board 5 for receiving a loud speaker (not shown). To have an alternative for mounting a loud speaker, a portion 26 of the rear cover plate 3 opposed to the portion 25 of the front wall 11 is provided. Furthermoe, in a lower portion of the fron thalf shell 2, a chamber 27 is provided for receiving a battery (not shown) which is electrically coupled to the circuit board 5 and supplies electric power necessary for operations of the pyroelectric sensor 51, and the synthesizing circuit. The hook element 54, the positioning pin 57, the snap-in arm 55, the loud speaker receiving portion 25 and the battery receiving chamber 27 may be formed integrally with the front half shell 2.

Figure 4:
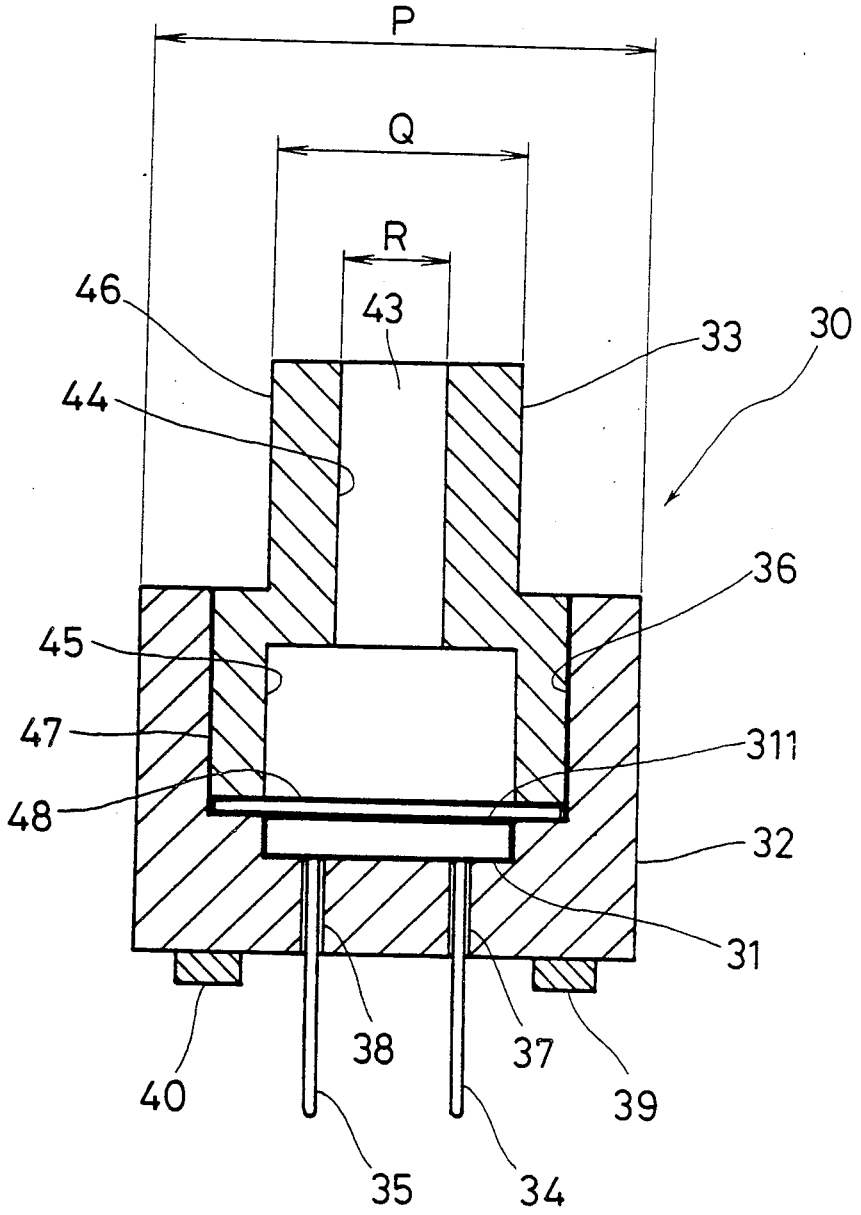
FIG. 4 is a sectional view of a luminosity variance detecting assembly used in the billboard according to an alternative embodiment of the present invention.

According to an alternative embodiment of the present invention, the billboard 10 of the present invention may be configured and arranged to generate an audio message output in response to the variance in the luminosity of a beam of light entered through the opening 23. As illustrated in FIG. 4, a luminosity variance detecting assembly 30 is used to substitute the combination of the reflecting plate 7 and the pyroelectric sensor 51 in the above-mentioned embodiment, and includes a photo-sensor 31, a mounting base 32 and a light directing tube 33. The photo-sensor 31 may be a photo-diode or a CdS sensor which has a sensing surface 311 and has leads 34 and 35 for connecting to the conventional audio message synthesizing circuit. The mounting base 32 is formed as a cup having a cavity 36 for receiving the photo-sensor 31 with leads 34 and 35 respectively passing through holes 37 and 38 in the bottom of the mounting base 32. The mounting base 32 is secured to the portion 24 of the rear cover plate 3 by means of protrustions 39 and 40 which are provided on a bottom surface of the mounting base 32 and are attached to the portion 24 by known fasterners such as screws, glue, rivets, pin-slit assemblies and the like. When the mounting base 32 is so secured, the sensing surface 311 of the photo-sensor 31 faces the opening 23 so as to detect the luminosity of a light beam entered through the opening 23 and impinging upon it.

The cavity 36 has a first inner diameter P. The light directing tube 33 has an inner through bore 43 which has a first portion 44 of a second inner diameter R and a second poriton 45 of a third inner diameter Q larger than the seocnd inner diameter R. The tube 33 has a first end 46 corresponding to the first portion 44 of the through bore 43 and a second end 47 corresponding to the second portion 45 of the through bore 43. The second end 47 has a largest outer diameter substantially equal to the first inner diameter P of the cavity 36 so that the tube 33 may be connected to the mounting base 32 by tightly inserting the second end 47 of the tube 33 into the cavity 36 with the photo-sensor 31 being laid between the second end 47 of the tube 33 and the mounting base 32 and with the first end 46 of the tube 33 being left outside of the cavity 36 and directed toward the opening 23 of the front wall 11. The first portion 44 of the inner through bore 43 defines a light path for the photo-sensor. The light path has an axis substantially perpendicular to the sensing surface 311 of the photo-sensor 31. The light path will allow only a light beam substantially parallel to its axis to impinge upon the sensing surface 311 of the sensor 31. In order to define a satisfactory light path, the second inner diameter R is in a range from approximately 1.50 mm to approximately 2.50 mm and, preferably, is approximately 2.0 mm.

In addition, a translucent plate 48 is disposed on the sensing surface 311 of the sensor 31 to provide a fainting effect for the sensor 31. The translucent plate 48 insures that the sensor 31 will receive a light beam at an acceptable level of luminosity.

When a person passes before the billboard 10 prepared with the luminosity variance detecting assembly 30, the sensor 31 will detect the presence of the person by sensing the variance in the luminosity of the light beam entering through the through bore 43. The variance in the luminosity of the entered light beam is caused by the movement of the person. An activating signal is generated by the sensor 31 in response to the detected variance. The activating signal is forwarded through leads 34 and 35 to the audio message synthesizing circuit on the printed circuit board 5 so as to allow for the output of the predetermined audio message stored in the memory IC 53.

Although the luminosity variance detecting assembly 30 according to the altenative embodiment of the present invention is described hereinbefore to be used as an alternative to the combination of the reflecting plate 7 and the pyroelectic sensor 51 according to the first embodiment of the present invention, the assembly 30 can be used together with the combination of the reflecting plate 7 and the pyroelectric sensor 51. Under this circumstance, the assembly 30 may be mounted beside the reflecting plate 7 while the first end 46 of the tube 33 and the reflecting surfaces of the plate 7 effectively face the opening 23 of the front wall 11.

Additionally, to obtain more an effect to catch eyes of a person passing before the billboard 10, an indicating lamp, which is not shown in the drawings and is configured to be actuated by the activating signal supplied by sensors 51 and/or 31 to generate a flashing light or a light in a different form when the person passes before the billboard 10, is provided together with its associated circuit at a proper location in the housing 1 of billboard 10. By way of example, the indicating lamp may be disposed beside the opening 23 with its associated circuit being provided on the circuit board 5. The associated circuit may be arranged to allow the lamp to operate for a predetermined period of time during which the predetermined audio message stored in memory IC 53 is spread.

Furthermore, a back-lighting arrangement may be incorporated into the billboard 10 to enhance the promoting effect. The first one of the ways to form a desired back-lighting arrangement is to make the front wall 11 of a transparent or translucent material while lamps are disposed either on the rear surface of the front wall 11 or on the circuit board 5 and are connected so as to be actuated by the activating signal supplied by sensors 51 and/or 31 to generate a back light for the advertising picture 6 interposed between the front wall 11 and the retaining plate 4. The back-lighting lamps may be kept on for a predetermined period of time during which the predetermined audio message stored in memory IC 53 is spread. Alternatively, the lamps may be connected so as to be constantly on. The second one of the ways to form a desired back-lighting arrangement is to make the front wall 11 of an electroluminescent material while electrodes for the electroluminescent material wall 11 are operatively coupled to sensors 51 and/or 31 so that it will generate in response to the activating signal a back light for the advertising picture 6 for the predetermined period of time. As an alternative, a film of an electroluminescent material bearing a predetermined pattern in connection with goods to be promoted may be used to take the place of the advertising picture 6. The electroluminescent material film may be formed so as either to luminesce only in its portions bearing the pattern or to luminesce in its entirety.

Although the invention has been hereinbefore described to be used as a billboard for promoting commercial goods, it should be understood that the invention may be embodied in the forms of a warning board, an alerting board and the like.

While the invention has been described in terms of what are presently considered to be the most practical and preferred embodiments, it is to be understood that the invention need not be limited to the disclosed embodiments. On the contrary, it is intended to cover various modifications and similarly arrangements included within the spirit and scope of the appended claims, the scope of which should be accorded the broadest interpretation so as to encompass all such modifications and similar structures.

What is claimed is:

1. A message spreading apparatus for generating an audio message output in response to the presence of heat radiation generated by human body heat, comprising:

a housing having a front wall and a rear wall spaced a predetermined distance from each other, said front wall having an opening, said rear wall having a first portion opposed to said opening of said front wall;

a radiation reflecting member mounted to said first portion of said rear wall and configured and arranged so as to reflect a portion of a heat radiation ray entered through said opening of said front wall to a path which is between said front wall and said rear wall and is in a direction substantially parallel to the respective planes of said front and rear walls;

a heat radiation sensing element provided in said path to sense the reflected heat radiation ray and generate an activating signal in response to the reflected heat radiation ray;

audio circuit means located between said front wall and said rear wall and operatively coupled to said heat radiation sensing element, for generating an audio message output in response to said activating signal, said radiation reflecting member including a led extending at an angle of approximately 45 degrees to the plane of said rear wall having a reflecting surface facing said opening in the front wall having opposite lateral edges and said reflecting plate further including first and second arms extending outwardly from respective opposite lateral edges of said reflecting plate leg in the direction of said heat radiation sensing element and at angles to the opening of said front wall so as to reflect a portion of the heat radiation ray which enters through said opening of said front wall but which does not directly impinge upon said first reflecting surface of said reflecting plate leg so as to be sensed by said sensing element.

2. A message spreading apparatus as claimed in claim 1, wherein said predetermined distance is in a range from 10 to 20 mm.

3. A message spreading apparatus as claimed in claim 2, wherein said predetermined distance is approximately 15 mm.

4. A message spreading apparatus as claimed in claim 1, wherein said sensing element comprises a pyroelectric sensor.

5. A message spreading apparatus as claimed in claim 1, wherein said audio circuit means includes memory means for prestoring predetermined audio message data and audio synthesizing circuit means coupled between said memory means and said sensing element for outputting said predetermined audio message in a synthetic audio voice form in response to said activating signal.

6. A message spreading apparatus as claimed in claim 1, wherein said front wall has a boundary ridge provided on an outer surface thereof in a portion of said front wall other than said opening and extending along edges of said other portion of said front wall, said ridge having recesses provided in the inner lateral side surfaces thereof, said ridge surrounding an area of a predetermined profile, and wherein said message spreading apparatus further comprises a flexible transparent retaining plate of a profile substantially the same as said predetermined profile of said area surrounded by said ridge so that said retaining plate is allowed to be received in position in said area surrounded by said ridge, said retaining plate having tabs provided along edges thereof at positions corresponding to the positions of said recesses on said ridge, each of said tabs extending outwardly a predetermined short distance from said edges of said retaining plate in the plane of said retaining plate so that when said retaining plate is received in said surrounded area, each of said tabs may be inserted into and releasably engaged in each of said recesses of said ridge so as to releasably hold said retaining plate in its recovered position.

7. A message spreading apparatus as claimed in claim 6, wherein said retaining plate has at least one notch provided along said edges thereof in a portion of said edges thereof other than the portions in which said tabs are provided, said notch being configured and arranged to be adapted to be engaged by a finger so as to allow said retaining plate to be removed from said received position by disengaging said tabs out of said recesses.

8. A message spreading apparatus for generating an audio message output in response to the presence of heat radiation generated by human body heat, comprising:

a housing having a front wall and a rear wall spaced a predetermined distance from each other, said front wall having an opening, said rear wall having a first portion opposed to said opening of said front wall;

a radiation reflecting member mounted to said first portion of said rear wall and configured and arranged so as to reflect a portion of a heat radiation ray entered through said opening of said front wall to a path which is between said front wall and said rear wall and is in a direction substantially parallel to the respective planes of said front and rear walls;

a heat radiation sensing element provided in said path to sense the reflected heat radiation ray and generate an activating signal in response to the reflected heat radiation ray;

audio circuit means located between said front wall and said rear wall and operatively coupled to said heaat radiation sensing element, for generating an audio message output in response to said activating signal, and wherein said reflecting member includes a reflecting plate having a pair of first and second legs, said first leg being mounted at a first end thereof to said first portion of said rear wall with a longitudinal axis of said first leg being substantially perpendicular to the plane of said rear wall, said first leg being connected at a second end thereof to a first end of said second leg, said second leg extending at an angle of approximately 45 degrees to the plane of said rear wall from said first end thereof toward said rear wall and being mounted at a second end thereof to said first portion of said rear wall, said second leg having a first reflecting surface provided between said first and second ends thereof and adapted to reflect a heat radiation ray, said first reflecting surface being configured and arranged to face said opening of said front wall at a first angle of approximately 45 degrees and said path at a second angle of approximately 45 degrees; thereby, when a heat radiation ray enters substantially perpendicularly through said opening of said front wall to impinge upon said first reflecting surface of said second leg, said heat radiation ray will be reflected to travel along said path so as to be sensed by said sensing element.

9. A message spreading apparatus as claimed in claim 8, wherein said reflecting plate further has a pair of first and second arms outwardly and inclinedly extending, near said first end of said second leg, respectively from each of the two opposite lateral edges of said second leg of said reflecting plate, said first arm and said second arm having second and third reflecting surfaces, respectively, configured and arranged to reflect a portion of a heat radiation ray which enters through said opening of said front wall but does not impinge upon said first reflecting surface toward said path so as to be sensed by said sensing element.

10. A message spreading apparatus as claimed in claim 9, wherein said first and second arms have respective planes and respective longitudinal axes, said respective planes of said first and second arms being respectively at an angle of approximately 45 degrees to the plane of said second leg, said respective longitudinal axes of said first and second arms being respectively at an angle of approximately 45 degrees to said respective opposite longitudinal lateral edges of said second leg.

11. A message spreading apparatus as claimed in claim 8, wherein said reflecting plate is made of metal material.

12. A message spreading apparatus for generating an audio message output in response to the presence of heat radiation generated by human body heat, comprising:

a housing having a front wall and a rear wall spaced a predetermined distance from each other, said front wall having an opening, said rear wall having a first portion opposed to said opening of said front wall;

a radiation reflecting member mounted to said first portion of said rear wall and configured and arranged so as to reflect a portion of a heat radiation ray entered through said opening of said front wall to a path which is between said front wall and said rear wall and is in a direction substantially parallel to the respective planes of said front and rear walls;

a heat radiation sensing element provided in said path to sense the reflected heat radiation ray and generate an activating signal in response to the reflected heat radiation ray;

audio circuit means located between said front wall and said rear wall and operatively coupled to said heat radiation sensing element, for generating an audio message output in response to said activating signal, wherein said audio circuit means includes memory means for prestoring predetermined audio message data and audio synthesizing circuit means coupled between said memory means and said sensing element for outputting said predetermined audio message in a synthetic audio voice form in response to said activating signal, and wherein said memory means comprises a memory IC for storing said predetermined audio message data and an IC socket for removably receiving said memory IC and for electrically connecting said memory IC to said audio synthesizing circuit means.

13. A message spreading apparatus as claimed in claim 12, wherein said audio circuit means further includes a printed circuit board for supporting said IC socket, said audio synthesizing circuit means and said sensing element thereon, said circuit board having an upper surface, a lower surface, an upper edge, a lower edge and a positioning hole, said positioning hole having a third diameter;

and wherein said front wall of said housing has:

a rear surface;

a pair of hook elements extending uprightly from said rear surface of said front wall and adapted to retain said upper edge of said printed circuit board;

a pair of resilient snap-in arms formed integrally with said front wall on said rear surface of said front wall and configured so that they may be urged to deflect so as to allow said lower edge of said printed circuit board to be held by said snap-in arms, each of said snap-in arms being formed into an inverse U-shaped form with one of the two legs of said U shape being shorter than the other, said shorter leg of each of said snap-in arms having a thickness and being configured so that when it retains said lower edge of said printed circuit board, it abuts against said upper surface of said printed circuit board along said lower edge of said printed circuit board with only a fraction of its thickness so as to allow it to be deflected by a small force to release said lower edge of said printed circuit board; and a positioning pin extending uprightly from said rear surface of said front wall and adapted to protrude through said positioning hole in said printed circuit board to help said board to be mounted in position, said pin being formed as a stepped post having an upper section of a first diameter and a lower section of a second diameter larger than said first diameter, said third diameter of said positioning hole being larger than said first diameter and smaller than said second diameter, said lower section of said pin being configured and arranged so that when said printed circuit board is pressed downward to bring said lower surface of said circuit board to be abutted against by said lower section of said pin, said shorter legs of said snap-in arms may engage said upper surface of said lower edge of said circuit board.

14. A message spreading apparatus as claimed in claim 13 further comprising a biasing spring body adapted to be laid beneath said circuit board before said lower edge of said circuit board is pressed down to be held by said snap-in arms, said biasing spring body having resiliency so that when said snap-in arms are deflected to release said lower edge of said circuit board, said spring body will urge said circuit board upward to allow an easy detachment of said circuit board from its received position.

15. A message spreading apparatus for generating an audio message output in response to the variance in the luminosity of a beam of light entering the apparatus, comprising:

a housing having a front wall and a rear wall spaced a predetermined distance from each other, said front wall having an opening adapted to allow a beam of light to enter therethrough, said rear wall having a first portion opposed to said opening of said front wall;

a luminosity variance detecting assembly mounted to said first portion of said rear wall and configured and arranged so as to detect the variance in the luminosity of the light beam entering through said opening of said front wall and to generate an activating signal in response to the detected variance; and audio circuit means located between said front wall and said rear wall and operatively coupled to said luminosity variance detecting assembly, for generating an audio message output in response to said activating signal;

said luminosity variance detecting assembly including a photo-sensor having a sensing surface for detecting the variance in the luminosity of a light beam impinged thereupon; a mounting base mounted to said first portion of said rear wall and having a cavity for receiving said photo-sensor, said cavity having a first inner diameter and being configured and arranged so as to receive said photo-sensor with said sensing surface of said photo-sensor facing said opening of said front wall; and a light directing tube component having an inner through bore which has a first portion of a second inner diameter and a second portion of a third inner diameter larger than said second inner diameter, said tube component having a first end corresponding to said first portion of said through bore and a second end corresponding to said second portion of said through bore with said second end having a largest outer diameter substantially equal to said first inner diameter of said cavity so that said tube component may be connected to said mounting base by inserting said second end of said tube component into said cavity with said photo-sensor being laid between said second end of said tube component and said mounting base and with said first end of said tube component being left outside of said cavity and directed toward said opening of said front wall to define in said through bore a light path for said photo-sensor, said light path having an axis substantially perpendicular to said sensing surface of said photo-sensor.

16. A message spreading apparatus as claimed in claim 15, wherein said photo-sensor comprises a photodiode.

17. A message spreading apparatus as claimed in claim 15, wherein said photo-sensor comprises a CdS sensor.

18. A message spreading apparatus as claimed in claim 15, wherein said second inner diameter is in a range from approximately 1.50 mm to approximately 2.50 mm.

19. A message spreading apparatus as claimed in claim 18, wherein said second inner diameter is approximately 2.0 mm.

* * * * *